US009768487B2

(12) United States Patent
Chen

(10) Patent No.: US 9,768,487 B2
(45) Date of Patent: Sep. 19, 2017

(54) ELECTRONIC DEVICE WITH PLUG

(75) Inventor: Qinna Chen, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 738 days.

(21) Appl. No.: 13/472,751

(22) Filed: May 16, 2012

(65) Prior Publication Data

US 2012/0223871 A1 Sep. 6, 2012

Related U.S. Application Data

(63) Continuation of application No. PCT/CN2010/078534, filed on Nov. 9, 2010.

(30) Foreign Application Priority Data

Nov. 19, 2009 (CN) ..... 2009 2 0253964 U

(51) Int. Cl.
*H01Q 1/08* (2006.01)
*H01Q 1/22* (2006.01)

(52) U.S. Cl.
CPC ..... *H01Q 1/08* (2013.01); *H01Q 1/2275* (2013.01)

(58) Field of Classification Search
CPC ..... H01Q 1/20
USPC ..... 343/883
See application file for complete search history.

(56) References Cited

U.S. PATENT DOCUMENTS 7,530,823 B1 * 5/2009 Thornton ..... H01Q 1/2275 439/131
2007/0030647 A1 * 2/2007 Chen ..... B60R 11/0235 361/679.21
2008/0305662 A1 12/2008 Regen et al.
2009/0102744 A1 * 4/2009 Ram ..... G06F 1/1601 345/1.1
2009/0215284 A1 8/2009 Zhao et al.
2010/0141847 A1 * 6/2010 Jayaram ..... H01Q 1/08 348/726

FOREIGN PATENT DOCUMENTS

CN 2660846 Y 12/2004
CN 201562778 U 8/2010
JP 559116 A 1/1980
JP 02-274046 11/1990
(Continued)

OTHER PUBLICATIONS

1st Office Action in corresponding Japanese Patent Application No. 2012-539169 (Jul. 23, 2013).
(Continued)

*Primary Examiner* — Dameon E Levi
*Assistant Examiner* — Andrea Lindgren Baltzell
(74) *Attorney, Agent, or Firm* — Leydig, Voit & Mayer, Ltd.

(57) ABSTRACT

An electronic device includes a shell, a circuit board disposed in the shell, a plug and an antenna that are electrically connected to the circuit board, and a linkage mechanism disposed between the plug and the antenna. When the plug extends from the shell, the plug drives the linkage mechanism and drives, through the linkage mechanism, the antenna to be stretched, or when the antenna is stretched, the antenna drives the linkage mechanism and drives, through the linkage mechanism, the plug so as to enable the plug to extend from the shell.

17 Claims, 8 Drawing Sheets

(56) References Cited

FOREIGN PATENT DOCUMENTS

| | | | |
|---|---|---|---|
| JP | 4330830 | A | 11/1992 |
| JP | 06-303295 | | 10/1994 |
| JP | 09-205384 | | 8/1997 |
| JP | 20047272 | A | 1/2004 |
| JP | 200432817 | A | 1/2004 |
| JP | 200512351 | A | 1/2005 |
| JP | 2004117284 | A | 10/2005 |
| JP | 2005303685 | A | 10/2005 |
| WO | WO 2009088415 | A1 | 7/2009 |
| WO | WO 2011060692 | A1 | 5/2011 |

OTHER PUBLICATIONS

Extended European Search Report in corresponding European Patent Application No. 10831107.7 (Sep. 19, 2012).
Written Opinion of the International Searching Authority in corresponding International Patent Application No. PCT/CN2010/078534 (Feb. 24, 2011).
International Search Report in corresponding International Patent Application No. PCT/CN2010/078534 (Feb. 24, 2011).

* cited by examiner

ELECTRONIC DEVICE WITH PLUG

CROSS-REFERENCE TO RELATED APPLICATIONS

This application is a continuation of International Application No. PCT/CN2010/078534, filed on Nov. 9, 2010, which claims priority to Chinese Patent Application No. 200920253964.1, filed on Nov. 19, 2009, both of which are hereby incorporated by reference in their entireties.

FIELD OF THE INVENTION

The present invention relates to the field of electronic technologies, and in particular, to an electronic device with a plug.

BACKGROUND OF THE INVENTION

With the development of the electronic technologies, different electronic devices with plugs such as data cards apply more and more widely.

As shown in FIG. 1, the prior electronic device with a plug includes a shell 1, a circuit board disposed in the shell 1, a plug 3 and an antenna 5 that are electrically connected to the circuit board, where the plug 3 and the antenna 5 are respectively hinged on the shell 1, or respectively extend from or retract to the shell 1 along a through hole of the shell 1, or one is hinged on the shell 1 and the other one extends from or retracts to the shell 1 along the through hole of the shell 1. An elastic mechanism controlled through a button 24 is also disposed between the plug 3 and the shell. When the plug 3 is retracted to the shell 1, the button 24 is pressed to activate the elastic mechanism so that the plug 3 extends from the shell 1, and the plug 3 is pulled or pushed so that when the plug 3 is retracted to the shell 1, the elastic mechanism locks the plug 3.

When the electronic device with a plug is used, the button 24 enabling the plug 3 pop from the shell 1 needs to be pressed first so that the plug 3 is in a state of being extended from the shell 1, the antenna 5 is pulled or drawn so that the antenna 5 is in a state of being stretched, and then the plug 3 is plugged in a slot of an information processing device (for example, a notebook, a mainframe box of a computer) corresponding to the plug 3. After the plug 3 is plugged, the information processing device may communicate with the circuit board through the plug 3 and a slot combining structure, and communicate with an external network base station by way of sending, and receiving a wireless signal through the antenna 5, so as to implement a function of information interaction such as surfing the Internet. After the using, for convenience of carrying, the plug 3 and the antenna 5 needs to be pulled or pushed manually, so that the plug 3 and the antenna 5 are in the state of being retracted again.

In the implementation of the present invention, the inventor found that the prior art at least has the following problems.

When the prior electronic device with a plug is used, the button 24 enabling the plug 3 as shown in FIG. 1 pop from the shell 1 must be pressed manually first so that the plug 3 is in the state of being extended from the shell 1, and then the antenna 5 is pulled or drawn so that the antenna 5 is in the state of being stretched. No matter the plug 3 is made in the state of being extended from the shell 1 first, or the antenna 5 is made in the state of being stretched first, two operations are required so that the positions of the plug 3 and the antenna 5 are in a usable state, so the operation is troublesome.

SUMMARY OF THE INVENTION

Embodiments of the present invention provide an electronic device with a plug, so as to solve the technical problem of troublesome operation of the prior electronic device with a plug.

In order to achieve the object, embodiments of the present invention adopt the following technical solutions:

The electronic device with a plug includes a shell, a circuit board disposed in the shell, a plug and an antenna that are electrically connected to the circuit board, and a linkage mechanism disposed between the plug and the antenna, where when the plug extends from the shell, the plug drives the linkage mechanism and drives, through the linkage mechanism, the antenna to be stretched, or when the antenna is stretched, the antenna drives the linkage mechanism and drives, through the linkage mechanism, the plug so as to enable the plug to extend from the shell.

Compared with the prior art, the technical solutions according to the present invention have the following advantages.

Because the linkage mechanism is disposed between the plug and the antenna of embodiments of the present invention, when the plug extends from the shell, the plug drives the linkage mechanism and drives, through the linkage mechanism, the antenna to be stretched, or when the antenna is stretched, the antenna drives the linkage mechanism and drives, through the linkage mechanism, the plug so as to enable the plug to extend from the shell. By employing the electronic device with a plug according to embodiments of the present invention, no matter the plug is enabled to extend from the shell first, or the antenna is enabled to be stretched first, only one operation is required to enable the positions of the plug and the antenna to be in a usable state, which is more convenient in operation as compared with the prior art, thereby solving the technical problem of troublesome operation of the prior electronic device with a plug.

BRIEF DESCRIPTION OF THE DRAWINGS

To describe the technical solutions according to the embodiments of the present invention or in the prior art more clearly, the accompanying drawings required for describing the embodiments or the prior art are introduced below briefly. Apparently, the accompanying drawings in the following descriptions show merely some of the embodiments of the present invention, and persons of ordinary skill in the art can obtain other drawings according to the accompanying drawings without creative efforts.

DETAILED DESCRIPTION OF THE EMBODIMENTS

The technical solutions of the present invention are clearly described in the following with reference to the accompanying drawings. It is obvious that the embodiments to be described are only a part rather than all of the embodiments of the present invention. All other embodiments obtained by persons of ordinary skill in the art based on the embodiments of the present invention without creative efforts shall fall within the protection scope of the present invention.

Embodiments of the present invention provide an electronic device with a plug, which is more convenient in use and simpler in operation.

Embodiment 1

Figure 1:
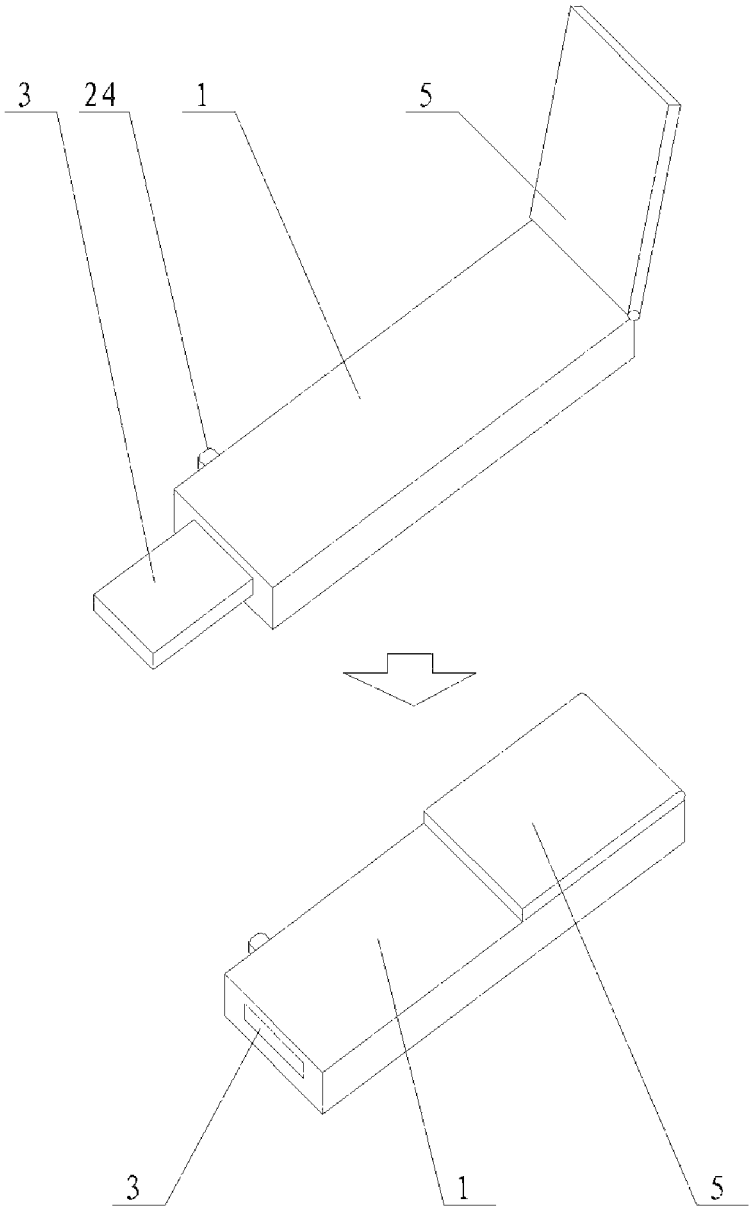
FIG. 1 is a three-dimensional schematic diagram in the prior art in which a plug of an electronic device with a plug changes from a state of being extended from a shell to a state of being retracted to the shell, and an antenna changes from a state of being stretched to a state of being retracted.
Figure 2:
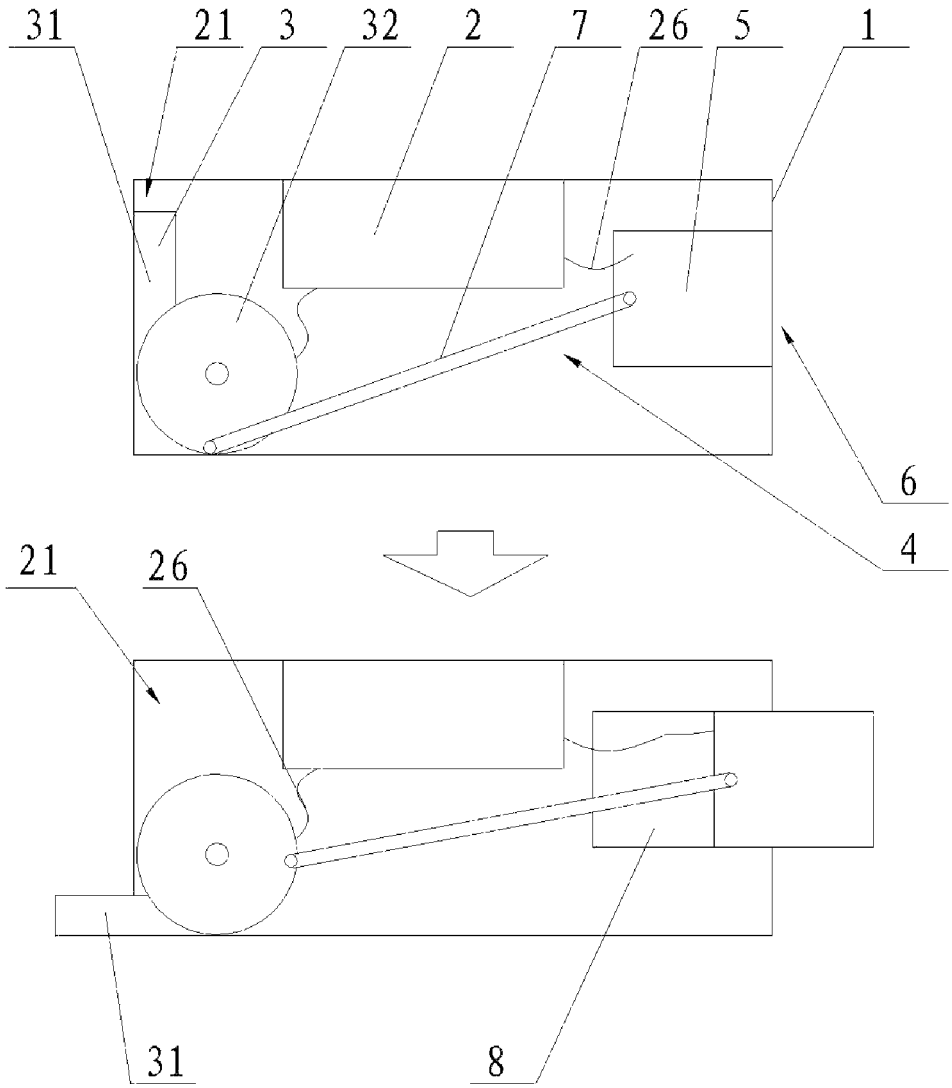
FIG. 2 is a schematic diagram of an implementation manner of an electronic device with a plug provided in Embodiment 1 of the present invention.

As shown in FIG. 2, an electronic device with a plug according to an embodiment of the present invention includes a shell 1, a circuit board 2 disposed in the shell 1, a plug 3 and an antenna 5 that are electrically connected to the circuit board 2, and a linkage mechanism 4 disposed between the plug 3 and the antenna 5. When the plug 3 extends from the shell 1, the plug 3 drives the linkage mechanism 4 and drives, through a linkage mechanism, the antenna 5 to be stretched, or when the antenna 5 is stretched, the antenna 5 drives the linkage mechanism 4 and drives, through the linkage mechanism, the plug 3 so as to enable the plug 3 to extend from the shell 1.

Because the linkage mechanism 4 is disposed between the plug 3 and the antenna 5 in the embodiment of the present invention, when the plug 3 extends from the shell 1, the plug 3 drives the linkage mechanism 4 and drives, through the linkage mechanism, the antenna 5 to be stretched, or when the antenna 5 is stretched, the antenna 5 drives the linkage mechanism 4 and drives, through the linkage mechanism, the plug 3 so as to enable the plug 3 to extend from the shell 1. By employing the electronic device with a plug provided in the embodiment of the present invention, no matter the plug 3 is enabled to extend from the shell 1 first, or the antenna 5 is enabled to be stretched first, only one operation is required to enable the plug 3 and the antenna 5 to be in a usable state, which is more convenient in operation as compared with the prior art, thereby solving the technical problem of troublesome operation of the prior electronic device with a plug.

In this embodiment, the plug 3 and the antenna 5 are electrically connected to the circuit board 2 through a flexible wire 26. When the plug 3 is retracted to the shell 1, the plug 3 drives the linkage mechanism 4 and drives, through the linkage mechanism, the antenna 5 so that the antenna 5 is retracted; or, when the antenna 5 is retracted, the antenna 5 drives the linkage mechanism 4 and drives, through the linkage mechanism, the plug 3 so that the plug 3 is retracted to the shell 1. To reduce space occupied by the electronic device with a plug and achieve the object of convenient carrying, after completing the use, the plug 3 and the antenna 5 need to be in a state of being retracted again. With the foregoing technical solutions according to the embodiment, after the electronic device with a plug is used, no matter the plug 3 is enabled to retract to the shell 1 first, or the antenna 5 is enabled to retract first, only one operation is required to enable the plug 3 and the antenna 5 to be in the state of being retracted again, thereby further making the present invention be more convenient in use, and simpler in operation.

The plug 3 includes a plug body 31 electrically connected to the circuit board 2 and a rotation part 32 of insulating materials that is fixedly disposed on one end of the plug body 31, where the rotation part 32 is hinged or pivoted on the shell 1 or the circuit board, and the plug 3 may rotate with the rotation part 32 to the state of being retracted to or extending from the shell 1. In this embodiment, the rotation part 32 is preferably hinged on the shell 1. The strength of the shell 1 is better than that of the circuit board, and therefore the connection structure between the rotation part 32 and the circuit board is more reliable. In one aspect, the rotation part 32 protects one end of the plug 3, ensuring that electrical connection between the plug body 31 and the circuit board 2 is reliable, and in another aspect, for an operation of hinging or pivoting performed on the rotation part 32, not only the space is large and the configuration is convenient, but also the performance of the electrical connection between the plug 3 and the circuit board 2 is not easily affected.

A through hole 6 is opened in the shell 1, where the antenna 5 extends from the through hole 6 when being stretched, and retracts to the through hole 6 when being retracted.

When being stretched, the antenna 5 extends from the through hole 6, and the shell 1 does not affect the signal receiving capacity of the antenna 5 so that a good receiving effect of the antenna 5 is ensured. After the antenna 5 retracts to the through hole 6, the shell 1 protects the antenna 5, and avoids an unintentional collision with the antenna 5 when the antenna 5 is being carried.

In this embodiment, the linkage mechanism 4 includes a link rod 7 of which one end is hinged or pivoted on the edge of the rotation part 32 and the other end is hinged or pivoted on the antenna 5, and a first guide rail 8 disposed inside the shell 1, where the antenna 5 is embedded in the first guide rail 8 and is capable of sliding, in the first guide rail 8, to the position in which the antenna 5 is in a retracted or stretched state. Because the link rod 7 is hinged or pivoted on the edge of the rotation part 32, when the antenna 5 is sliding inside the first guide rail 8, the rotation part 32 may rotate around a position where the rotation part 32 is hinged or pivoted on the plug body 31 under the pulling of the link rod 7, and the plug body 31 is driven to rotate at the same time, when the antenna 5 slides, in the first guide rail 8, to the position in which the antenna 5 is in a retracted or stretched state, the plug 3 rotates to the position in which the plug 3 is in a state of being retracted to or extending from the shell 1 under the drawing of the link rod 7.

Figure 3:
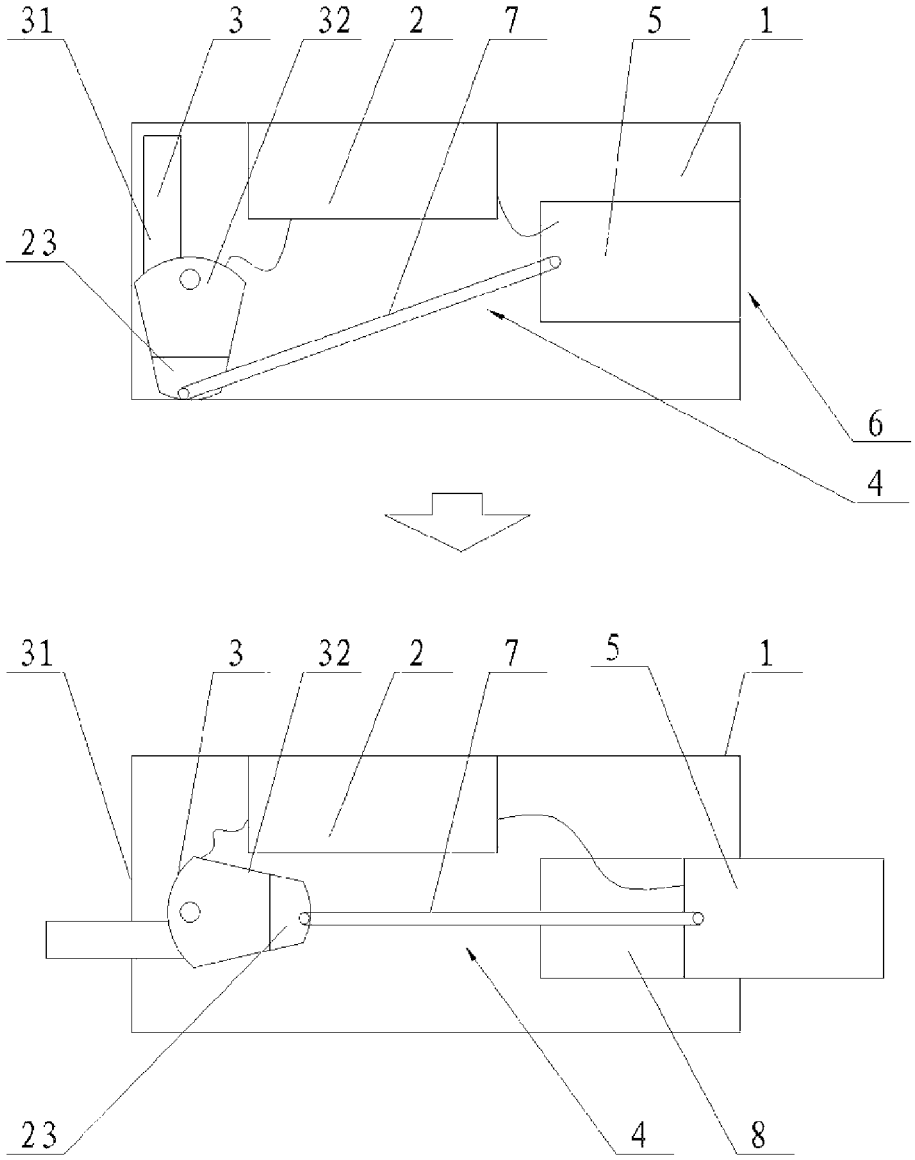
FIG. 3 is a schematic diagram of another implementation manner of an electronic device with a plug provided in Embodiment 1 of the present invention.

In this embodiment, it is assumed that the rotation part 32 is a circle shape as shown in FIG. 2 or a cam shape as shown in FIG. 3, and on the rotation part 32, a link part 23 is disposed on the edge of a position where the rotation part 32 is hinged or pivoted on the shell 1, where the edge is far away from the position, and the link rod 7 is hinged or pivoted on the link part 23. The link part 23 and the rotation part 32 may be an integrated structure or separated structures that are assembled and fixedly connected. On the rotation part 32, the rotation part 23 is disposed on the edge of a position where the rotation part 32 is hinged or pivoted on the shell 1, where the edge is far from the position, which increases the pulling distance of the rod 7 when the antenna 5 slides or the plug 3 rotates, so that the rotation part 32 may drive the large size antenna 5 to slide to the position in which the antenna 5 is in a retracted or stretched state.

In this embodiment, the electronic device is a mobile broadband device, such as a wireless modem configured to implement mobile wireless access to the Internet. The plug is a plug of a USB interface, where the plug may be a USB rotation plug, or a direct push type USB plug, which is used to connect to a user terminal having a USB interface, such as a personal computer, so as to implement connection of the personal computer to the Internet through the mobile broadband device. The antenna is a telescopic antenna configured to implement radio frequency transmission and receiving between the mobile broadband device and a wireless communication network. When the mobile broadband device is in a working state, the antenna is stretched or extends from the shell, and when the mobile broadband device does not work, the antenna is retracted to the shell.

Figure 4:
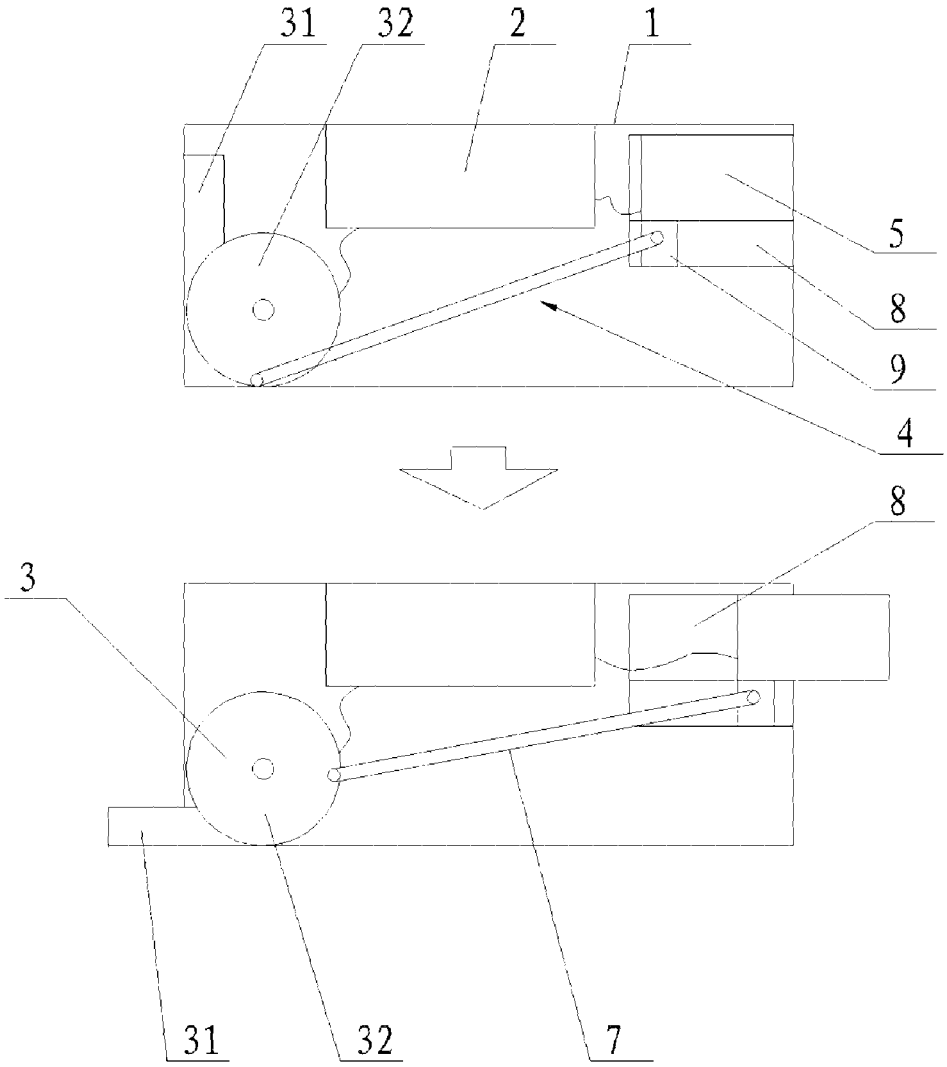
FIG. 4 is a schematic diagram of still another implementation manner of an electronic device with a plug provided in Embodiment 1 of the present invention.

As shown in FIG. 4, it is another implementation manner of this embodiment. A sliding block 9 is fixedly disposed on the antenna 5, one end of the link rod 7 is hinged or pivoted on the edge of the rotation part 32, and the other end is hinged or pivoted on the sliding block 9, where the sliding block 9 is embedded in the first guide rail 8 and may slide in the first guide rail 8, and the sliding block 9, when sliding, may drive the antenna 5 to retract or stretch. Because the sliding block 9 is fixedly connected to the antenna 5, the sliding block 9, when sliding, inevitably drives the antenna 5 to slide, and the configuration of the sliding block 9 increases the space for performing hinging or pivoting between the antenna 5 and the link rod 7.

As shown in FIG. 2, the embodiment is further improved. In this embodiment, a groove 21 is opened on the shell 1, and the plug 3, when being retracted to the shell 1, may be embedded in the groove 21 and a gap exists between the plug and a side wall of the groove 21. When the plug 3 is retracted to the shell 1, the plug is embedded in the groove 21. In such case, the side wall of the groove 21 protects the plug 3, the gap between the plug 3 and the side wall of the groove 21 is convenient for users, when using the electronic device, a user may pick out the plug 3 through a finger, so that the plug 3 is in a state of extending from the shell 1.

Embodiment 2

Figure 5:
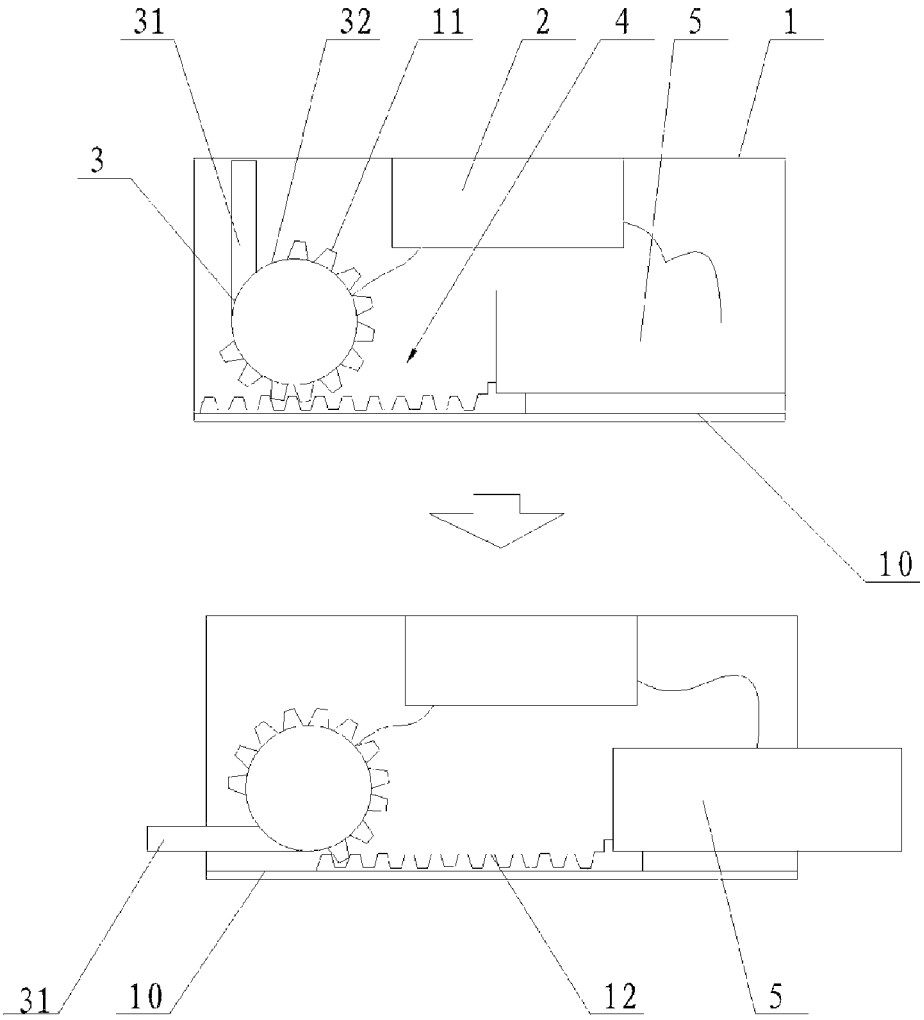
FIG. 5 is a schematic diagram of an electronic device with a plug provided in Embodiment 2 of the present invention.

As shown in FIG. 5, this embodiment is basically the same as Embodiment 1, the difference lies in: in this embodiment, a linkage mechanism 4 includes a first gear 11 fixedly disposed on a rotation part 32, a second guide rail 10 disposed in a shell 1, and a first rack 12 embedded in the second guide rail 10 and meshed with the first gear 11, where the first rack 12 is fixedly connected to an antenna 5, the first rack 12 may slide in the second guide rail 10, and the first rack 12, when sliding, drives the antenna 5 to retract or stretch.

Because the first gear 11 is fixedly connected to the rotation part 32 of a plug 3, the rotation part 32, when rotating, drives the first gear 11 to rotate, and the first gear 11, when sliding, drives the first rack 12 meshed with the first gear 11 to slide in the second guide rail 10. In this way, by rotating the plug 3 and the rotation part 32, the objective of controlling the antenna 5 to retract or stretch is achieved. On the contrary, by pulling the antenna 5, the objective of controlling the plug 3 to retract or to extend from the shell 1 is also achieved.

In this embodiment, the electronic device is a mobile broadband device, such as a wireless modem configured to implement mobile wireless access to the Internet. The plug is a plug of a USB interface, where the plug may be a USB rotation plug, or a direct push type USB plug, which is used to connect to a user terminal having a USB interface, such as a personal computer, so as to implement connection of the personal computer to the Internet through the mobile broadband device. The antenna is a telescopic antenna configured to implement radio frequency transmission and receiving between the mobile broadband device and a wireless communication network. When the mobile broadband device is in a working state, the antenna is stretched or extends from the shell, and when the mobile broadband device does not work, the antenna is retracted to the shell.

Embodiment 3

Figure 6:
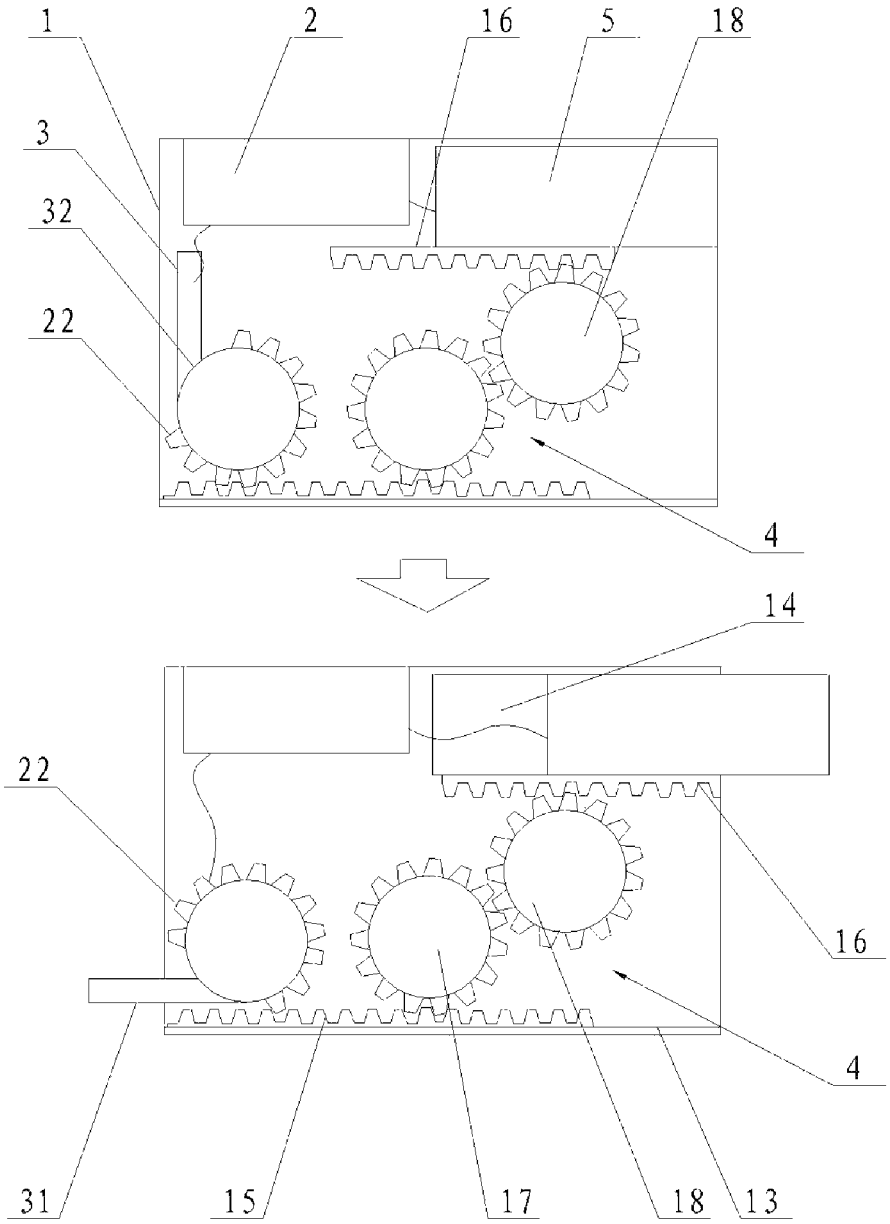
FIG. 6 is a schematic diagram of an electronic device with a plug provided in Embodiment 3 of the present invention.

As shown in FIG. 6, this embodiment is basically the same as Embodiment 1, the difference lies in: a linkage mechanism 4 of this embodiment includes a second gear 22 fixedly disposed on a rotation part 32, a third guide rail 13 and a fourth guide rail 14 that are disposed in a shell 1, a second rack 15 that is embedded in third guide rail 13 and meshed with the second gear 22, a third rack 16 that is embedded in the fourth guide rail 14 and fixedly connected to the antenna 5, and a third gear 17 and a fourth gear 18 that are hinged in the shell 1 and meshed with each other.

The third rack 16 may slide in the fourth guide rail 14, and the third rack 16, when sliding, drives the antenna 5 to retract or stretch.

The third gear 17 is meshed with the second rack 15, and the fourth gear 18 is meshed with the third rack 16.

In this embodiment, when the plug 3 rotates to a position in which the plug 3 is in a state of extending from or retracted to the shell 1, the rotation part 32 that rotates drives the second gear 22 fixedly connected to the rotation part 32 to rotate together, and the second gear 22 drives the second rack 15 to slide in the third guide rail 13, the sliding second rack 15 further drives the third rack 16 to rotate and drives, through the third rack 16, the fourth gear 18 to rotate, and the fourth gear 18 that rotates further drives the third rack 16 to slide in the fourth guide rail 14. Because the third rack 16 is fixedly connected to the antenna 5, the sliding third rack 16 also drives the antenna 5 to slide to a position in which the antenna 5 is in a retracted or stretched state.

In this embodiment, the electronic device is a mobile broadband device, such as a wireless modem configured to implement mobile wireless access to the Internet. The plug is a plug of a USB interface, where the plug may be a USB rotation plug, or a direct push type USB plug, which is used to connected to a user terminal having a USB interface, such as a personal computer, so as to implement connection of the personal computer to the Internet through the mobile broadband device. The antenna is a telescopic antenna configured to implement radio frequency transmission and receiving between the mobile broadband device and a wireless communication network. When the mobile broadband device is in a working state, the antenna is stretched or extends from the shell, and when the mobile broadband device does not work, the antenna is retracted to the shell.

Embodiment 4

Figure 7:
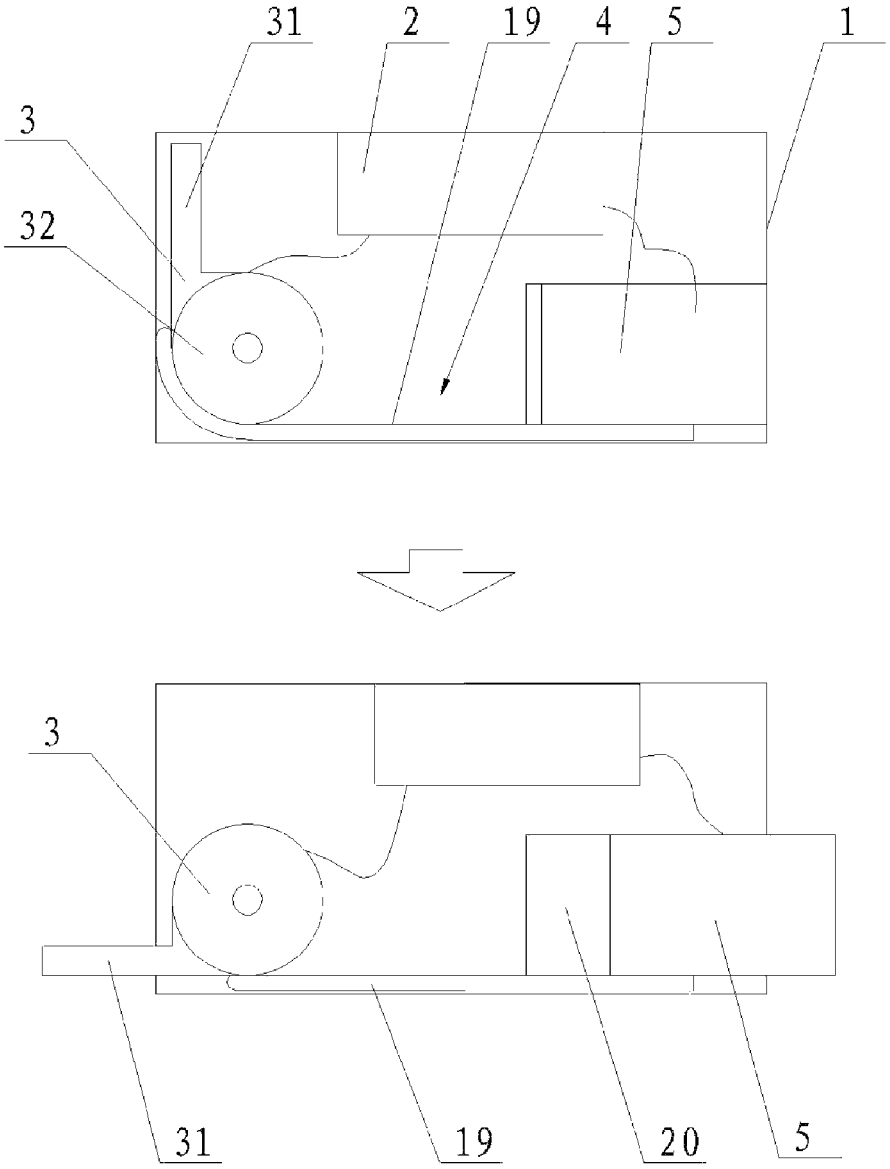
FIG. 7 is a schematic diagram of an implementation manner of an electronic device with a plug provided in Embodiment 4 of the present invention.

As shown in FIG. 7, this embodiment is basically the same as Embodiment 1, the difference lies in: in this embodiment, a linkage mechanism 4 includes a soft belt 19 of which one end is fixedly connected to a rotation part 32 and winds the rotation part 32 and the other end is fixedly connected to the antenna 5, and an antenna guide rail 20 disposed in the shell 1, where the antenna 5 may slide to a position in which the antenna 5 is in a retracted or stretched state in the antenna guide rail 20.

When a plug 3 rotates to the position in which the plug 3 is in a state of extending from or retracting to the shell 1, the rotation part 32 of the plug 3 rotates as well and pulls the soft belt 19 at the same time. Because the soft belt 19 winds the rotation part 32, the soft belt 19, when being pulled, drives the antenna 5 to slide, in the antenna guide rail 20, to a position in which the antenna 5 is in a retracted or stretched state. On the contrary, when the antenna 5 slides, in the antenna guide rail 20, to the position in which the antenna 5 is in a stretched or retracted state, the antenna 5 also pulls the soft belt 19, and pulls the rotation part 32 through the soft belt 19 so that the plug 3 rotates to the position in which the plug 3 is in a state of extending from or retracting to the shell 1. For convenience of sliding the antenna 5, a slot parallel to the antenna guide rail 20 may be opened in the shell 1, and a finger may move the antenna 5 through the slot so that the antenna 5 slides in the antenna guide rail 20. Definitely, a moving part may also be fixedly connected to and extended from the antenna 5, and a finger may move the antenna 5 to slide in the antenna guide rail 20 through the moving part. In this embodiment, when the antenna 5 slides, in the antenna guide rail 20, to the position in which the antenna 5 is in a stretched state, the plug 3 rotates to the position in which the plug 3 is in a state of extending from the shell 1, and when the plug 3 rotates to the position in which the plug 3 is in a state of being retracted to the shell 1, the antenna 5 slides, in the antenna guide rail 20, to position in which the antenna 5 is in a retracted state.

In this embodiment, the electronic device is a mobile broadband device, such as a wireless modem configured to implement mobile wireless access to the Internet. The plug is a plug of a USB interface, where the plug may be a USB rotation plug, or a direct push type USB plug, which is used to connect to a user terminal having a USB interface, such as a personal computer, so as to implement connection of the personal computer to the Internet through the mobile broadband device. The antenna is a telescopic antenna configured to implement radio frequency transmission and receiving between the mobile broadband device and a wireless communication network. When the mobile broadband device is in a working state, the antenna is stretched or extends from the shell, and when the mobile broadband device does not work, the antenna is retracted to the shell.

Figure 8:
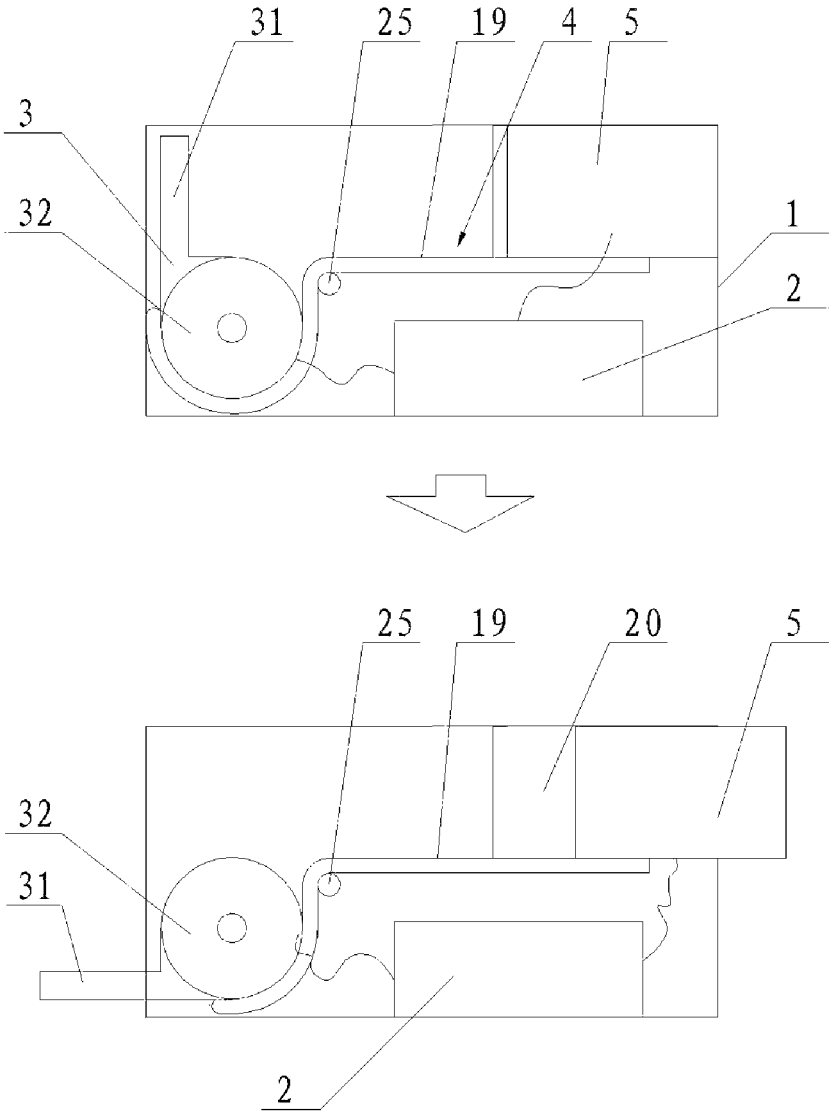
FIG. 8 is a schematic diagram of another implementation manner of an electronic device with a plug provided in Embodiment 4 of the present invention.

As shown in FIG. 8, this embodiment is further improved. The linkage mechanism 4 further includes a sling wheel 25 fixedly disposed in the shell 1, and the soft belt 19 fixedly connected to the rotation part 32 is fixedly connected to the antenna 5 after passing through the sling wheel 25. The sling wheel 25 may limit and tense the soft belt 19.

The foregoing descriptions are merely several embodiments of the present invention, but not intended to limit the present invention. Various variations and modifications made by persons skilled in the art without departing from the idea of the present invention fall within the protection scope of the present invention. Therefore, the protection scope of the present invention is subject to the appended claims.

What is claimed is:

1. An electronic device comprising:

a shell;

a circuit board disposed in the shell;

a plug electrically connected to the circuit board;

an antenna electrically connected to the circuit board; and a linkage mechanism disposed between the plug and the antenna, wherein when the plug extends from the shell, the plug drives the linkage mechanism and drives, through the linkage mechanism, the antenna to be stretched, wherein when the antenna is stretched, the antenna drives the linkage mechanism and drives, through the linkage mechanism, the plug so as to enable the plug to extend from the shell, wherein the plug includes:

a plug body electrically connected to the circuit board; and a rotation part of insulating materials that is fixedly disposed on one end of the plug body, wherein the rotation part is hinged or pivoted on the shell or the circuit board, and the plug rotates with the rotation part to a position in which the plug is in a state of being retracted to or extending from the shell, and wherein a through hole is opened in the shell, the antenna extends from the through hole when being stretched, and the antenna is retracted to the through hole when being retracted.

2. The electronic device according to claim 1, wherein when the plug is retracted to the shell, the plug drives the linkage mechanism and drives, through the linkage mechanism, the antenna so that the antenna is retracted, and wherein when the antenna is retracted, the antenna drives the linkage mechanism and drives, through the linkage mechanism, the plug so that the plug is retracted to the shell.

3. The electronic device according to claim 1, wherein the linkage mechanism comprises a link rod of which one end is hinged or pivoted on the edge of the rotation part and the other end is hinged or pivoted on the antenna; and a first guide rail disposed in the shell, wherein the antenna is embedded in the first guide rail and is configured for sliding, in the first guide rail, to a position in which the antenna is retracted or stretched.

4. The electronic device according to claim 1, further comprising:

a sliding block is fixedly disposed on the antenna, wherein the linkage mechanism comprises a link rod of which one end is hinged or pivoted on the edge of the rotation part and the other end is hinged or pivoted on the sliding block, and the sliding block is embedded in a first guide rail and is configured for sliding in the first guide rail, and the sliding block, when sliding, drives the antenna to retract or stretch.

5. The electronic device according to claim 1, wherein the linkage mechanism comprises a first gear fixedly disposed on the rotation part;

a guide rail disposed in the shell; and a first rack embedded in the guide rail and meshed with the first gear, wherein the first rack is fixedly connected to the antenna, the first rack is configured for sliding in the guide rail, and the first rack, when sliding, drives the antenna to retract or stretch.

6. The electronic device according to claim 1, wherein the linkage mechanism comprises:

a first gear fixedly disposed on the rotation part;

a first guide rail and a second guide rail that are disposed in the shell;

a first rack embedded in the first guide rail and meshed with the first gear;

a second rack embedded in the second guide rail and fixedly connected to the antenna; and a second gear and a third gear that are pivoted on the shell and meshed with each other, wherein:

the second rack is configured for sliding in the second guide rail, and the second rack, when sliding, drives the antenna to retract or stretch; and the second gear is meshed with the first rack, and the third gear is meshed with the second rack.

7. The electronic device according to claim 1, wherein the linkage mechanism comprises a soft belt of which one end is fixedly connected to the rotation part and winding the rotation part and the other end is fixedly connected to the antenna; and an antenna guide rail disposed in the shell, wherein the antenna is configured for sliding in the antenna guide rail to the position in which the antenna is retracted or stretched.

8. The electronic device according to claim 2, wherein a groove is opened in the shell, and the plug, when being retracted to the shell, is embedded in the groove and a gap exists between the plug and a side wall of the groove.

9. The electronic device according to claim 1, wherein the electronic device is a wireless modem, and the plug is a USB plug.

10. A wireless modem comprising:

a shell;

a circuit board disposed in the shell;

a USB plug electrically connected to the circuit board;

an antenna electrically connected to the circuit board; and a linkage mechanism disposed between the USB plug and the antenna, wherein when the USB plug extends from the shell, the USB plug drives the linkage mechanism and drives, through the linkage mechanism, the antenna to be stretched, and wherein when the antenna is stretched, the antenna drives the linkage mechanism and drives, through the linkage mechanism, the USB plug so as to enable the USB plug to extend from the shell, wherein the USB plug includes:

a plug body electrically connected to the circuit board; and a rotation part of insulating materials that is fixedly disposed on one end of the plug body, wherein the rotation part is hinged or pivoted on the shell or the circuit board, and the plug rotates with the rotation part to a position in which the plug is in a state of being retracted to or extending from the shell, and wherein a through hole is opened in the shell, the antenna extends from the through hole when being stretched, and the antenna is retracted to the through hole when being retracted.

11. A wireless modem comprising:

a shell;

a circuit board disposed in the shell;

a USB plug electrically connected to the circuit board;

an antenna electrically connected to the circuit board; and a linkage mechanism disposed between the USB plug and the antenna, wherein:

when the USB plug extends from the shell, the USB plug drives the linkage mechanism and drives, through the linkage mechanism, the antenna to be stretched, when the antenna is stretched, the antenna drives the linkage mechanism and drives, through the linkage mechanism, the USB plug so as to enable the USB plug to extend from the shell, the USB plug includes a plug body electrically connected to the circuit board and a rotation part of insulating materials that is fixedly disposed on one end of the plug body, the rotation part being hinged or pivoted on the shell or the circuit board, and the USB plug rotates with the rotation part to a position in which the USB plug is in a state of being retracted to or extending from the shell, a groove is opened in the shell, and the USB plug, when being retracted to the shell, is embedded in the groove and a gap exists between the USB plug and a side wall of the groove, and a through hole is opened in the shell, the antenna extends from the through hole when being stretched, and the antenna is retracted to the through hole when being retracted.

12. The electronic device according to claim 1, wherein the rotation part is fixedly disposed on a first end of the shell and the through hole is disposed on a second end of the shell, and the first end is oppositely disposed from the second end.

13. The wireless modem according to claim 10, wherein the rotation part is fixedly disposed on a first end of the shell and the through hole is disposed on a second end of the shell, and the first end is oppositely disposed from the second end.

14. The wireless modem according to claim 11, wherein the rotation part is fixedly disposed on a first end of the shell and the through hole is disposed on a second end of the shell, and the first end is oppositely disposed from the second end.

15. The electronic device according to claim 1, wherein the antenna extends through the through hole when being stretched, and the antenna is retracted through the through hole when being retracted.

16. The wireless modem according to claim 10, wherein the antenna extends through the through hole when being stretched, and the antenna is retracted through the through hole when being retracted.

17. The wireless modem according to claim 11, wherein the antenna extends through the through hole when being stretched, and the antenna is retracted through the through hole when being retracted.

* * * * *